US006681731B2

(12) United States Patent
Mianzo et al.

(10) Patent No.: US 6,681,731 B2
(45) Date of Patent: Jan. 27, 2004

(54) VARIABLE VALVE MECHANISM FOR AN ENGINE

(75) Inventors: Lawrence A. Mianzo, Plymouth, MI (US); Brett D. Collins, Ypsilanti, MI (US); Zeljko Popovic, Sterling Heights, MI (US); Ibrahim Haskara, Brownstown, MI (US); Harold S. Hilbert, Canton, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/066,107

(22) Filed: Jan. 31, 2002

(65) Prior Publication Data

US 2003/0106510 A1 Jun. 12, 2003

Related U.S. Application Data

(60) Provisional application No. 60/339,573, filed on Dec. 11, 2001.

(51) Int. Cl.[7] ..... F01L 9/04

(52) U.S. Cl. ..... 123/90.11; 123/90.16; 123/90.27; 251/129.01; 251/129.16

(58) Field of Search ..... 123/90.11, 90.16, 123/90.27; 251/129.01, 129.02, 129.16

(56) References Cited

U.S. PATENT DOCUMENTS

| | | | | |
|---|---|---|---|---|
| 4,515,343 A | | 5/1985 | Pischinger et al. | 251/48 |
| 4,533,890 A | | 8/1985 | Patel | 335/234 |
| 4,544,986 A | | 10/1985 | Buchl | 361/152 |
| 4,614,170 A | | 9/1986 | Pischinger et al. | 123/90.11 |
| 4,762,095 A | * | 8/1988 | Mezger et al. | 123/90.11 |
| 4,777,915 A | | 10/1988 | Bonvallet | 123/90.11 |
| 4,867,111 A | * | 9/1989 | Schneider et al. | 123/90.11 |
| 5,222,714 A | | 6/1993 | Morinigo et al. | 251/129.16 |
| 5,546,268 A | | 8/1996 | Hurley et al. | 361/154 |
| 5,592,905 A | | 1/1997 | Born | 123/90.11 |
| 5,791,305 A | | 8/1998 | Kather et al. | 123/90.11 |
| 5,917,692 A | | 6/1999 | Schmitz et al. | 361/187 |
| 6,003,481 A | | 12/1999 | Pischinger et al. | 123/90.11 |
| 6,009,841 A | * | 1/2000 | Hickey | 123/90.15 |
| 6,047,672 A | | 4/2000 | Hanai et al. | 123/90.11 |
| 6,066,999 A | | 5/2000 | Pischinger | 335/266 |
| 6,073,651 A | | 6/2000 | Conrads et al. | 137/556 |
| 6,085,704 A | * | 7/2000 | Hara | 123/90.11 |
| 6,202,609 B1 | | 3/2001 | Metz | 123/90.11 |
| 6,257,182 B1 | * | 7/2001 | Hara et al. | 123/90.11 |
| 6,262,498 B1 | * | 7/2001 | Leiber | 310/12 |
| 6,269,784 B1 | | 8/2001 | Newton | 123/90.11 |
| 6,276,317 B1 | | 8/2001 | Yoeda et al. | 123/90.11 |
| 6,390,036 B1 | * | 5/2002 | Yuuki | 123/90.11 |
| 6,427,650 B1 | * | 8/2002 | Cristiani et al. | 123/90.11 |
| 6,467,441 B2 | * | 10/2002 | Cristiani et al. | 123/90.11 |
| 6,516,758 B1 | * | 2/2003 | Leiber | 123/90.11 |

* cited by examiner

*Primary Examiner*—C. Chang
(74) *Attorney, Agent, or Firm*—Brinks Hofer Gilson & Lione

(57) ABSTRACT

The variable valve mechanism of a preferred embodiment of the invention includes a valve slidably mounted to move between a closed position and an open position, a cam rotatably mounted to push the valve from the closed position toward the open position, and an electromagnet adapted to selectively hold the valve in the open position. The variable valve mechanism acquires most of the benefits of a bi-directional electromagnetic arrangement (such as increased fuel economy, decreased start-up emissions, etc.), while avoiding most of the disadvantages (costs, NVH, etc.).

12 Claims, 1 Drawing Sheet

VARIABLE VALVE MECHANISM FOR AN ENGINE

CROSS-REFERENCE TO RELATED APPLICATIONS

The present invention claims priority to U.S. Ser. No. 60/339,573, filed on Dec. 11, 2001 and entitled "Method for Passive or Semi-Active Soft-Landing for an Electromagnetic Actuator".

TECHNICAL FIELD

This invention relates generally to the engine field and, more specifically, to a new and useful variable valve mechanism for an engine.

BACKGROUND

In conventional engines, a rotating cam pushes a valve from a closed position to an open position. The open position of the valve typically allows a fuel-and-air mixture into a cylinder or allows a combusted mixture out of the cylinder. The closed position of the valve typically allows a spark to combust the fuel-and-air mixture. In a conventional engine, the valve must open and close at a rate up to nearly 90 cycles per second. For this reason, a biasing device, such as a coil spring, swiftly pushes the valve from the open position into the closed position after sufficient rotation of the cam.

Recent progress in the engine field suggests the use of a variable valve mechanism to selectively open and close valves based upon several data signals, such as emissions data. Some systems to pursue this goal have used a dual electromagnet arrangement: one to magnetically pull an armature connected to a valve from a closed position into an open position and one to magnetically pull the valve from the open position to the closed position. These systems, such as the system found in U.S. Pat. No. 6,269,784 entitled "Electrically Actuable Engine Valve Providing Position Output", issued on Aug. 7, 2001, and incorporated by this reference in its entirety, have increased fuel economy and decreased start-up emissions. These systems, however, have typically suffered from cost and noise-vibration-harshness (NVH) problems.

Thus, there is a need in the engine field to create a new and useful variable valve mechanism.

DESCRIPTION OF THE PREFERRED EMBODIMENT

The following description of the preferred embodiment of the invention is not intended to limit the invention to this preferred embodiment, but rather to enable any person skilled in the engine field to make and use this invention.

Figure 1:
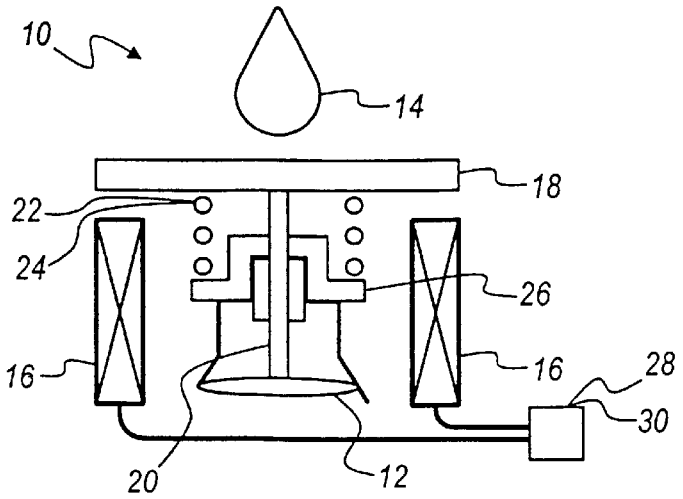
FIG. 1 is a schematic representation of the preferred embodiment, shown with a valve in a closed position.

As shown in FIG. 1, the variable valve mechanism 10 of the preferred embodiment includes a valve 12 slidably mounted to move between a closed position and an open position (shown in FIGS. 2 and 3), a cam 14 rotatably mounted to push the valve 12 from the closed position toward the open position, and an electromagnet 16 adapted to selectively hold the valve 12 in the open position. Because of these elements, the variable valve mechanism 10 acquires most of the benefits of a dual electromagnet arrangement (such as increased fuel economy, decreased start-up emissions, etc.), while avoiding most of the disadvantages (costs, NVH, etc.). The variable valve mechanism 10 may include other elements, including the preferred elements described below, that do not interfere with the functions of these elements. Further, although the variable valve mechanism 10 has been specifically designed for an engine (not shown) of a vehicle (not shown), the variable valve mechanism 10 may be used in any suitable environment, such as an aircraft, a watercraft, or a stationary power supply.

Figure 2:
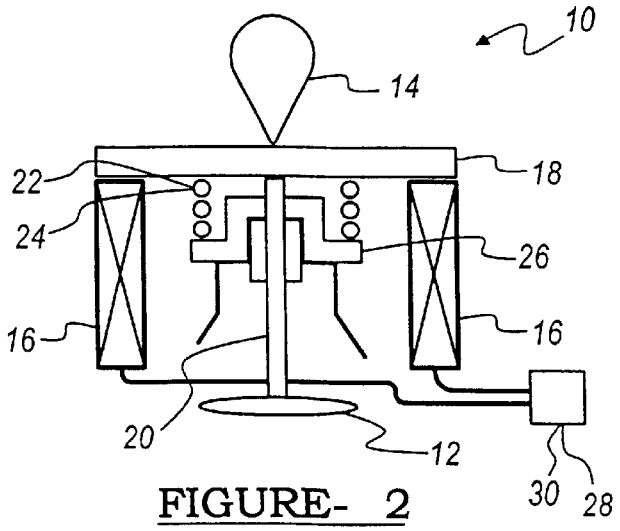
FIG. 2 is a schematic representation of the preferred embodiment, shown with the valve in an open position.
Figure 3:
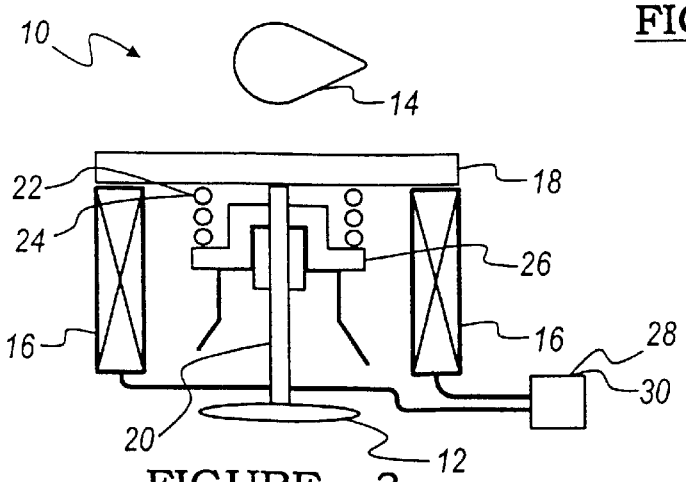
FIG. 3 is a schematic representation of the preferred embodiment, shown with the valve held in the open position by an electromagnet.

The valve 12 of the preferred embodiment functions to selectively inhibit fluid flow in the closed position or allow fluid flow into a cylinder (not shown) of the engine in the open position (shown in FIGS. 2 and 3). The size and shape of the valve 12 is partially determined by the ideal fluid flow into the cylinder, but may be determined by numerous factors in the particular application of the invention. The valve 12 is preferably a conventional element made from a conventional strong material, such as steel, and with conventional methods, such as forging, but may alternatively be made from any suitable material and with any suitable method.

The preferred embodiment also includes an armature 18 coupled to the valve 12, which allows the electromagnet 16 to selectively hold the valve 12 in the open position. The armature 18 is preferably cylindrically shaped with a sufficient diameter to be held by the electromagnet 16 and with a sufficient thickness to avoid significant deformation. Preferably, the armature 18 is preferably a conventional element made from a metallic material, such as steel or iron, and with conventional methods, such as forging. Alternatively, the armature 18 may be made from any suitable material attracted to an electromagnet 16 and with any suitable method.

The preferred embodiment also includes a valve stem 20, which functions to connect the armature 18 and the valve 12. The valve stem 20 is preferably cylindrically shaped with a sufficient diameter and a sufficient outward taper at both ends to avoid significant deformation during the repeated opening and closing of the valve 12. The valve stem 20 is preferably a conventional element made from a strong material, such as steel, and with conventional methods, such as forging, but may alternatively be made from any suitable material and with any suitable method.

The cam 14 of the preferred embodiment functions to open the valve 12 by pushing the valve 12 from the closed position toward the open position, as shown in FIG. 2. In the preferred embodiment, the cam 14 contacts the armature 18 at a point generally along a line defined by the valve stem 20. In alternative embodiments, the cam 14 may contact the valve 12, the valve stem 20, or any other suitable device to push the valve 12. The cam 14 is preferably shaped to push the valve 12 the entire distance from the closed position to the open position, but may alternatively be shaped to push the valve 12 through only a portion of this distance with the remaining force supplied by the electromagnet 16 or any other suitable device. The cam 14, like the cams of a conventional engine, is preferably rotated by an output of the engine, but may alternatively be rotated by any suitable power source. The cam 14 is preferably a conventional element made from a strong material, such as steel, and with conventional methods, such as forging, but may alternatively be made from any suitable material and with any suitable method.

The electromagnet 16 of the preferred embodiment functions to selectively hold open the valve 12, as shown in FIG. 3. The electromagnet 16 creates a sufficient magnetic field to attract and hold an outer portion of the armature 18 against the electromagnet 16. The electromagnet 16 is preferably positioned in several locations around the valve stem 20 and activated simultaneously, which substantially avoids bending forces on the armature 18 and the valve stem 20. The engine preferably indirectly powers the electromagnet 16 through an electric generator (not shown) and a battery (not shown). The electromagnet 16 may, however, be powered by any suitable power source. The electromagnet 16 is preferably a conventional element, but may be any suitable element able to selectively energize and de-energize at a rate up to nearly 90 cycles per second.

The preferred embodiment also includes a biasing device 22, which functions to push the valve 12 from the open position into the closed position. Preferably, the biasing device 22 includes a conventional coil spring 24 made from conventional materials, such as steel. Alternatively, the biasing device 22 may include any suitable device that nearly instantaneously acts upon the valve 12 after the de-energizing of the electromagnet 16. The biasing device 22 is preferably strong enough to push the valve 12 from the open position to the closed position during the de-energized state of the electromagnet 16, but is preferably not strong enough to overcome the magnetic attraction or move the valve 12 during the energized state of the electromagnet 16. The biasing device 22 preferably contacts the armature 18 generally at a point located radially inward of the electromagnet 16, which minimizes the package volume of the variable valve mechanism 10. The biasing device 22, however, may alternatively contact the armature 18 at another suitable position or may push or pull the valve 12, the valve stem 20, or any other suitable device.

The preferred embodiment also includes a valve guide 26, which functions to confine the movement of the valve 12 to one axis. Preferably, the valve guide 26 also includes a flange to support the biasing device 22. Alternatively, another suitable device may support the biasing device 22. The valve guide 26 is preferably made from of a convention material, such as metal or plastic, but may alternatively be made from any suitable material.

The preferred embodiment also includes a control unit 28, which functions to control the state of the electromagnet 16. In the preferred embodiment, the control unit 28 is also adapted to actively determine an optimum time duration for the open position of the valve 12. This determination is preferably aided by the receipt of data signals from several sensors (not shown), such as emission data signals from an emissions sensor. Based on the optimum time duration for the open position of the valve 12, the control unit 28 energizes the electromagnet 16 to hold the valve 12 in the open position and de-energizes the electromagnet 16 to achieve the optimum time duration for the open position of the valve 12. The actual timing for the de-energizing (or "release") of the electromagnet 16 will be predetermined using several factors, including the closing duration and profile for the valve 12. The de-energizing of the electromagnet 16 allows the biasing device 22 to push the valve 12 from the open position into the closed position (shown in FIG. 1). In a conventional engine with a cam-actuated valve mechanism, the typical valve is both opened and closed based upon the rotation of a typical cam. In an engine with the preferred embodiment, on the other hand, the valve 12 is opened based upon the rotation of the cam 14, but is held open by the electromagnet 16 and eventually closed with the biasing device 22. Because the electromagnet 16 and the biasing device 22 act independently of the cam 14, the valve 12 may be held open for a variable time duration. Thus, unlike conventional engine with a cam-actuated valve mechanism, the duration of the open position of the valve 12 may be based upon a real-time calculation of the optimum time duration. The control unit 28 is preferably a conventional microprocessor 30, but may be any suitable element able to accept data signals, determine an optimum time duration for the open position of the valve 12, and send signals to selectively energize and de-energize the electromagnet 16 at a rate up to nearly 90 cycles per second.

The preferred method of operating the variable valve mechanism 10 includes the following acts: rotating the cam 14 to push the valve 12 from the closed position (shown in FIG. 1) into the open position (shown in FIG. 2); further rotating the cam 14 while determining an optimum time duration for the open position of the valve 12 and energizing the electromagnet 16 to selectively hold the valve 12 in the open position (shown in FIG. 3); and de-energizing the electromagnet 16 upon the conclusion of the optimum time duration and allowing the biasing device 22 to push the valve 12 from the open position into the closed position (shown in FIG. 1). Alternative methods may include other steps that do not interfere with the functions of these acts.

As any person skilled in the engine field will recognize from the previous detailed description and from the figures and claims, modifications and changes can be made to the preferred embodiment without departing from the scope of this invention defined in the following claims.

We claim:

1. A variable valve mechanism for an engine, comprising:

a valve with a valve stem slidably mounted to move between a closed position and an open position;

a cam rotatably mounted to push said valve from the closed position toward the open position;

an electromagnet adapted to selectively hold said valve in the open position;

an armature connected to said valve stem; and a biasing device to push said valve from the open position into the closed position;

wherein said cam contacts said armature at a point generally along a line defined by said valve stem to push said valve from the closed position toward the open position; wherein said electromagnet contacts said armature to selectively hold said valve in the open position; and wherein said biasing device contacts said armature generally at a point located radially inward of said electromagnet to push said valve from the open position into the closed position.

2. The variable valve mechanism of claim 1 further comprising a control unit adapted to determine an optimum time duration for the open position of said valve.

3. The variable valve mechanism of claim 2 wherein said control unit energizes said electromagnet to hold said valve in the open position and de-energizes said electromagnet to achieve the optimum time duration for the open position of said valve.

4. A variable valve mechanism for an engine, comprising:

a valve slidably mounted to move between a closed position and an open position;

an armature connected to the valve;

a cam rotatably mounted for continuous rotation in a first direction and to alternatively contact the armature to push said valve from the closed position toward the open position and to allow movement of said valve from the open position to the closed position;

a biasing device adapted to push said valve from the open position to the closed position; and an electromagnet adapted to selectively overcome said biasing device and hold said valve in the open position.

5. The variable valve mechanism of claim 4 further comprising an armature and a valve stem; wherein said valve stem connects said armature and said valve; and wherein said electromagnet contacts said armature to selectively hold said valve in the open position.

6. The variable valve mechanism of claim 4 wherein said cam contacts said armature at a point generally along a line defined by said valve stem.

7. The variable valve mechanism of claim 5 wherein said biasing device contacts said armature to push said valve from the open position into the closed position.

8. The variable valve mechanism of claim 7 wherein said biasing device contacts said armature at a point located radially inward of said electromagnet.

9. The variable valve mechanism of claim 4 further comprising a control unit adapted to determine an optimum time duration for the open position of said valve.

10. The variable valve mechanism of claim 9 wherein said control unit energizes said electromagnet to hold said valve in the open position and de-energizes said electromagnet to achieve the optimum time duration for the open position for said valve.

11. A method of providing and operating a variable valve mechanism for an engine, comprising:

providing a valve connected to an armature by a valve stem:

slidably mounting the valve to move between a closed position and an open position;

providing biasing device to bias the valve in the closed position;

rotating a cam to contact the armature to push the valve from the closed position to the open position;

energizing the electromagnet to selectively hold the valve in the open position;

further rotating the cam out of contact with the armature; de-energizing the electromagnet; and allowing the biasing device to push the valve from the open position into the closed position.

12. The method of claim 11, further comprising determining an optimum time duration for the open position of the valve; wherein said act of de-energizing occurs to achieve the optimum time duration for the open position of the valve.

* * * * *

UNITED STATES PATENT AND TRADEMARK OFFICE

CERTIFICATE OF CORRECTION

PATENT NO. : 6,681,731 B2
DATED : January 27, 2004
INVENTOR(S) : Lawrence A. Mianzo et al.

It is certified that error appears in the above-identified patent and that said Letters Patent is hereby corrected as shown below:

Title page,
Item [56], References Cited, U.S. PATENT DOCUMENTS, insert
-- 6,321,706 11/2001 Wing --.

Column 4,
Lines 5-6, after "rotation" delete "in a first direction and".

Column 6,
Line 7, before "biasing" insert -- a --.

Signed and Sealed this

Twenty-fifth Day of May, 2004

JON W. DUDAS
*Acting Director of the United States Patent and Trademark Office*